US006752205B2

(12) United States Patent
Kutac et al.

(10) Patent No.: US 6,752,205 B2
(45) Date of Patent: Jun. 22, 2004

(54) INFLATABLE PACKER WITH PRESTRESSED BLADDER

(75) Inventors: Andrew Kutac, Hallettsbille, TX (US); Paul A. Reinhardt, Houston, TX (US); Dennis E. Roessler, Houston, TX (US); Charles O. Stokley, Houston, TX (US)

(73) Assignee: TAM International, Inc., Houston, TX (US)

( * ) Notice: Subject to any disclaimer, the term of this patent is extended or adjusted under 35 U.S.C. 154(b) by 0 days.

(21) Appl. No.: 10/124,662

(22) Filed: Apr. 17, 2002

(65) Prior Publication Data

US 2003/0196795 A1 Oct. 23, 2003

(51) Int. Cl.[7] ..... E21B 33/127
(52) U.S. Cl. ..... 166/187; 166/387
(58) Field of Search ..... 166/387, 187, 166/131, 133, 184

(56) References Cited

U.S. PATENT DOCUMENTS

| | | | | | |
|---|---|---|---|---|---|
| 4,768,590 | A | | 9/1988 | Sanford et al. | 166/187 |
| 4,832,120 | A | * | 5/1989 | Coronado | 166/187 |
| 4,886,117 | A | | 12/1989 | Patel | 166/187 |
| 4,951,747 | A | * | 8/1990 | Coronado | 166/187 |
| 4,967,846 | A | | 11/1990 | Wood | 166/387 |
| 5,197,542 | A | * | 3/1993 | Coone | 166/122 |
| 5,271,461 | A | * | 12/1993 | Decker et al. | 166/185 |
| 5,271,469 | A | * | 12/1993 | Brooks et al. | 166/387 |
| 5,340,626 | A | * | 8/1994 | Head | 277/334 |
| 5,417,289 | A | * | 5/1995 | Carisella | 166/387 |
| 5,495,892 | A | * | 3/1996 | Carisella | 166/387 |
| 5,564,504 | A | | 10/1996 | Carisella | 166/387 |
| 5,605,195 | A | | 2/1997 | Eslinger et al. | 166/387 |
| 5,613,555 | A | | 3/1997 | Sorem et al. | 166/187 |
| 5,813,459 | A | | 9/1998 | Carisella | 166/187 |
| 6,158,506 | A | | 12/2000 | Carisella | 166/187 |
| 6,223,820 | B1 | | 5/2001 | Carisella | 166/187 |
| 6,315,053 | B1 | | 11/2001 | Coronado | 166/387 |

FOREIGN PATENT DOCUMENTS

| | | |
|---|---|---|
| GB | 2213180 | 12/1988 |
| GB | 2237593 | 10/1990 |
| GB | 2354273 | 9/2000 |

* cited by examiner

*Primary Examiner*—David Bagnell
*Assistant Examiner*—Kenneth L Thompson
(74) *Attorney, Agent, or Firm*—Browning Bushman, P.C.

(57) ABSTRACT

An improved inflatable packer 10 is provided having a pre-stretched bladder to minimize Z-folding. An expandable outer body 11 includes an inner elastomeric bladder layer 12, a reinforcement layer 14 which may include overlapping slats or cable, and an outer elastomer cover layer 16 which may cover only a portion of the reinforcement layer 14. The bladder 12 may expand non-uniformly due to the variations in the cross-section of the borehole 20, irregularities in construction of the bladder 12, and/or difference in resistance to expansion between the covered portion and the exposed portion of the reinforcement layer 14. An improved inflatable packer and method comprises pre-stretching the bladder 12 to keep the bladder in tension and minimize the occurrence of Z-folds.

23 Claims, 17 Drawing Sheets

INFLATABLE PACKER WITH PRESTRESSED BLADDER

FIELD OF THE INVENTION

The present invention relates to inflatable packers, and particularly to an inflatable packer with a bladder that reliably and controllably expands downhole.

BACKGROUND OF THE INVENTION

An inflatable packer is used in a downhole wellbore to seal the inside of the wellbore or a downhole tubular. The packer includes an inner mandrel and an outer expandable body which typically is constructed of three layers:

(1) a bladder or inner elastomer layer;

(2) a reinforcement layer or layers with a reinforcing material, such as slats or cable; and (3) a cover or outer elastomer layer.

A portion of the lower-friction elastomer cover is commonly removed so the higher-friction reinforcement layer contacts the borehole wall, providing a more secure fit between the inflated packer and the borehole. Fluid pressure is applied in the space between the OD of the mandrel and the ID of the bladder layer surrounding the mandrel to expand the packer inside the borehole. As the bladder expands, it causes the surrounding reinforcement layer and cover layer to expand against the borehole.

Due to variations in the cross-section of the borehole, irregularities in the construction (geometry) or material homogenity of either the bladder, the reinforcement layer or the cover, or due to the different expansion where the end of the cover exposes the reinforcement layer, the bladder may expand non-uniformly, causing the bladder to fold at one or more locations. The non-uniform expansion increases the overall length of the bladder, and that excess length may accumulate in the area referred to as a "Z-fold." Some areas within and adjacent to the Z-fold may be highly stretched due to expansion, and other areas adjacent to the Z-fold may be compressed due to the excess length. The Z-fold may worsen with increased pressure and expansion, overstressing the bladder. If stresses exceed the elastic limit of the elastomer or bladder, the packer will fail. Packer failure may result in hundreds of thousands of dollars expended to replace the failed packer, and to repair the damage to other downhole tools or the formation.

Elastomers used in bladders fail predictably when stretched beyond their elastic limit, which limit may be expressed as a percentage. As a precaution, the manufacturer will usually specify a packer whose maximum stress in a given application will be substantially lower than the elastic limit. For example, if the elastomer used in a packer has an elastic limit of 600% elongation, the manufacturer may recommend using it in applications in which the maximum stretch will not exceed 400%, with further downward adjustments for high-temperature or harsh environments. Despite such precautions, packers often fail as a result of Z-folding, and replacement can be time consuming and costly.

Numerous patents have addressed techniques to control bladder expansion to minimize the risk of failure. Patents of interest include U.S. Pat. Nos. 6,315,053; 6,223,820; 6,158,506; 5,813,459; 5,613,555; 5,605,195; 5,564,504; 4,967,846; 4,886,117; and 4,768,590.

The disadvantages of the prior art are overcome by the present invention, and an improved inflatable packer is disclosed below with a packer element or bladder offering more reliable and controlled expansion.

SUMMARY OF THE INVENTION

This invention discloses an improved technique for controlling expansion of a packer to minimize folding of the bladder, commonly referred to as Z-folding, thereby improving the reliability of the expansion process and reducing the likelihood of failure.

In one embodiment, a sleeve-shaped bladder surrounds a packer tube, and a radially outward reinforcement layer extends axially between upper and lower packer subs. A cover may be provided only over a limited portion of the reinforcement layer so that when the packer expands, the exposed portion of the reinforcement layer engages the ID of the wellbore.

To minimize the likelihood of Z-folds, the bladder is placed in tension by stretching it axially between the upper and lower packer subs prior to inflation. This may be done either before or after the packer is placed in the wellbore. The pre-stretched configuration allows the bladder to inflate uniformly, because the tension in the bladder essentially pulls out the Z-fold as it forms. Because the bladder is in tension, the region within and adjacent to a Z-fold that would ordinarily be compressed will instead merely experience a reduction in tension. Pre-stretching essentially removes the excess length that would otherwise accumulate in a Z-fold.

It is an object of the present invention to provide an inflatable packer with an elastomeric bladder stretched between the upper and lower packer subs to prevent Z-folding. Prior to inflation, the bladder is axially stretched an amount equal to the elongation it might otherwise experience as a result of folding.

A related object of the invention is to provide an improved method of inflating a packer downhole in a wellbore by pre-stretching the bladder between the upper packer sub and the lower packer sub to minimize the occurrence of Z-folds.

It is a feature of the invention that both the upper and lower packer sub of the assembled packer may be substantially fixed with respect to the packer tube, so that the bladder is axially stretched during manufacture of the packer.

Another feature of this invention is that at least one of the upper packer sub and the lower packer sub may be axially movable relative to the packer tube while the packer is downhole to pre-stretch the bladder downhole prior to inflation. Hydraulic or pneumatic pressure may be used to move the movable sub axially relative to the stationary sub to pre-stretch the bladder prior to inflation of the packer. In another embodiment, a mechanical biasing member such as a spring may be used to move the movable sub axially relative to the stationary sub to pre-stretch the bladder prior to inflation of the packer.

A further feature of this invention is that the packer may include a reinforcement layer surrounding at least a portion of the bladder for engaging the inside of a wellbore. The bladder may be pre-stretched prior to fitting the bladder between the OD of the packer tube and the ID of the reinforcement layer.

A further feature of the invention is that the elastomeric bladder may preferably be pre-stretched a fixed amount of at least 10%, commonly at least 25%, or preferably at least 40% of its unstretched length, which may provide high reliability against folding, while remaining substantially below the elastic limit of the bladder. Pre-stretching a selected fixed amount allows a single packer to be used in one of a variety of different applications and expansion ratios.

A significant advantage of the present invention is that the reliability of a packer may be substantially improved.

A related advantage is a reliable packer having a pre-stretched bladder may be constructed with a minimal increase in cost as compared with prior art packers. The cost to pre-stretch the bladder is small relative to the overall cost of the packer. Yet another advantage of pre-stretching a bladder by a fixed amount is the bladder may be easier and less expensive to manufacture than a packer whose bladder is custom-stretched for a specific application. A bladder pre-stretched by a fixed amount may protect against Z-folds in a variety of packer applications.

Still another advantage of a packer having a moveable packer sub is the user may custom stretch a packer to adapt it to a chosen application.

These and further objects, feature, and advantages of the present invention will become apparent from the following detailed description, when reference is made to the figures in the accompanying drawings.

BRIEF DESCRIPTION OF THE DRAWINGS

An exemplary inflatable packer is shown in FIG. 1 in the non-inflated condition as run into a borehole. A cover is provided on only the lower portion of the exemplary packer, so that the overlapping strap-type reinforcement is exposed for more reliably holding the packer in position after inflation.

FIG. 9 is an enlarged portion of the tool shown in FIG. 8, focused on the pre-stretch mechanism. FIG. 10 illustrates the packer at the beginning of inflation. FIG. 11 is an enlarged view of the tool when inflation pressure initially stretches the bladder via a movable piston. FIG. 12 shows the piston topped out and the bladder totally stretched. FIG. 13 shows engagement of a snap ring to lock the elongation of the bladder, closing off the elongation chamber and opening the inflate port to the packer bladder.

DETAILED DESCRIPTION OF PREFERRED EMBODIMENTS

Figure 1:
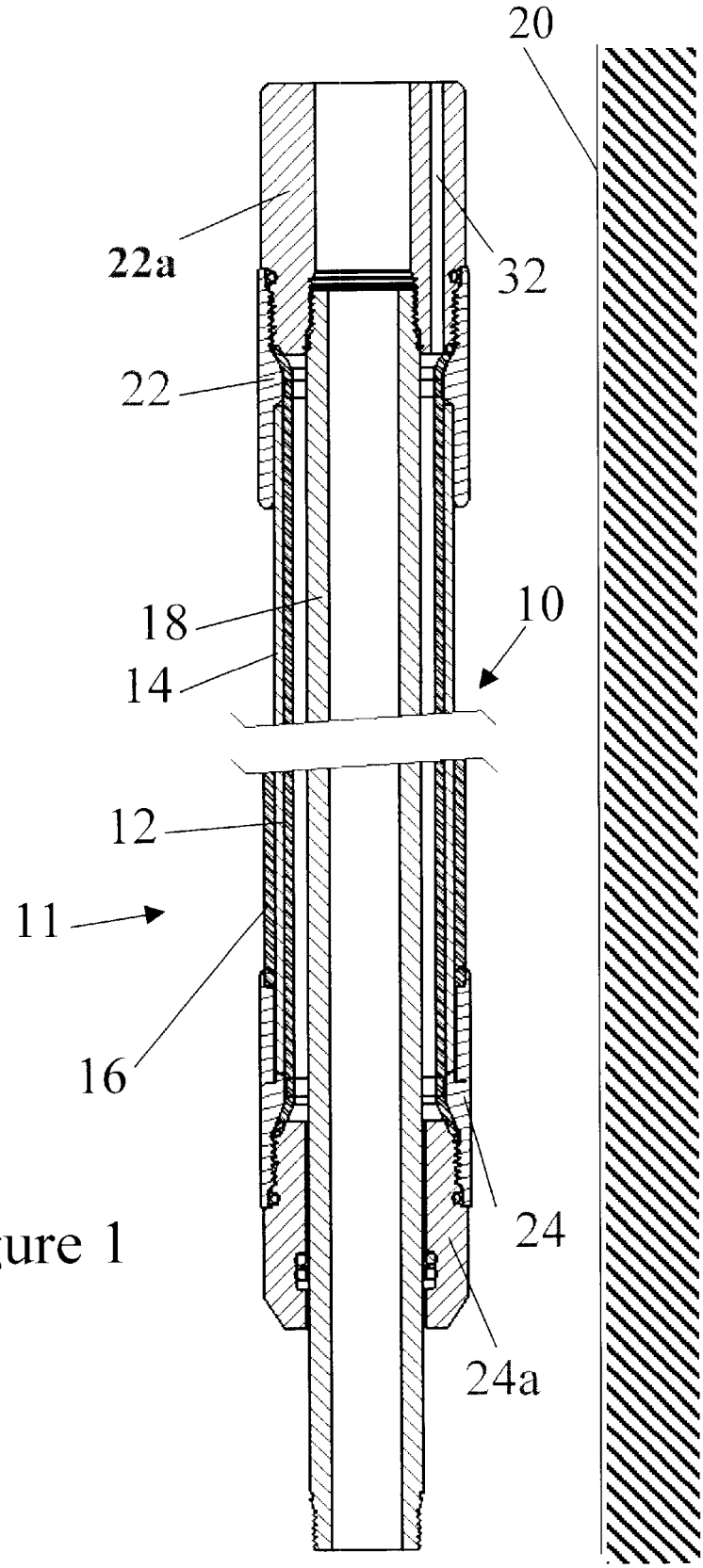

FIG. 1 illustrates the general construction of an inflatable packer 10 prior to inflation for use in a borehole, which may be open hole, cased hole, screened hole, or other hole defined in part by an oilfield tubular. The expandable outer body 11 includes an inner elastomer bladder layer 12, a reinforcement layer or layers 14 which may include slats, cable, or other reinforcing material, such as a composite material, and an outer elastomer cover layer 16. The ends of the bladder 12 are secured to an upper packer sub 22 and a lower packer sub 24. When inside a borehole 20, the tube-like packer 10 includes an inner mandrel 18 and the outer inflatable body 11. Fluid pressure is applied in the annulus between the OD of the mandrel 18 and the ID of the bladder 12 to expand the packer 10 inside the borehole 20. A portion of the cover 16 may be removed so that the higher-friction reinforcement layer 14 contacts the borehole 20 to provide a more secure connection between the packer 10 and the borehole 20.

Figure 2:
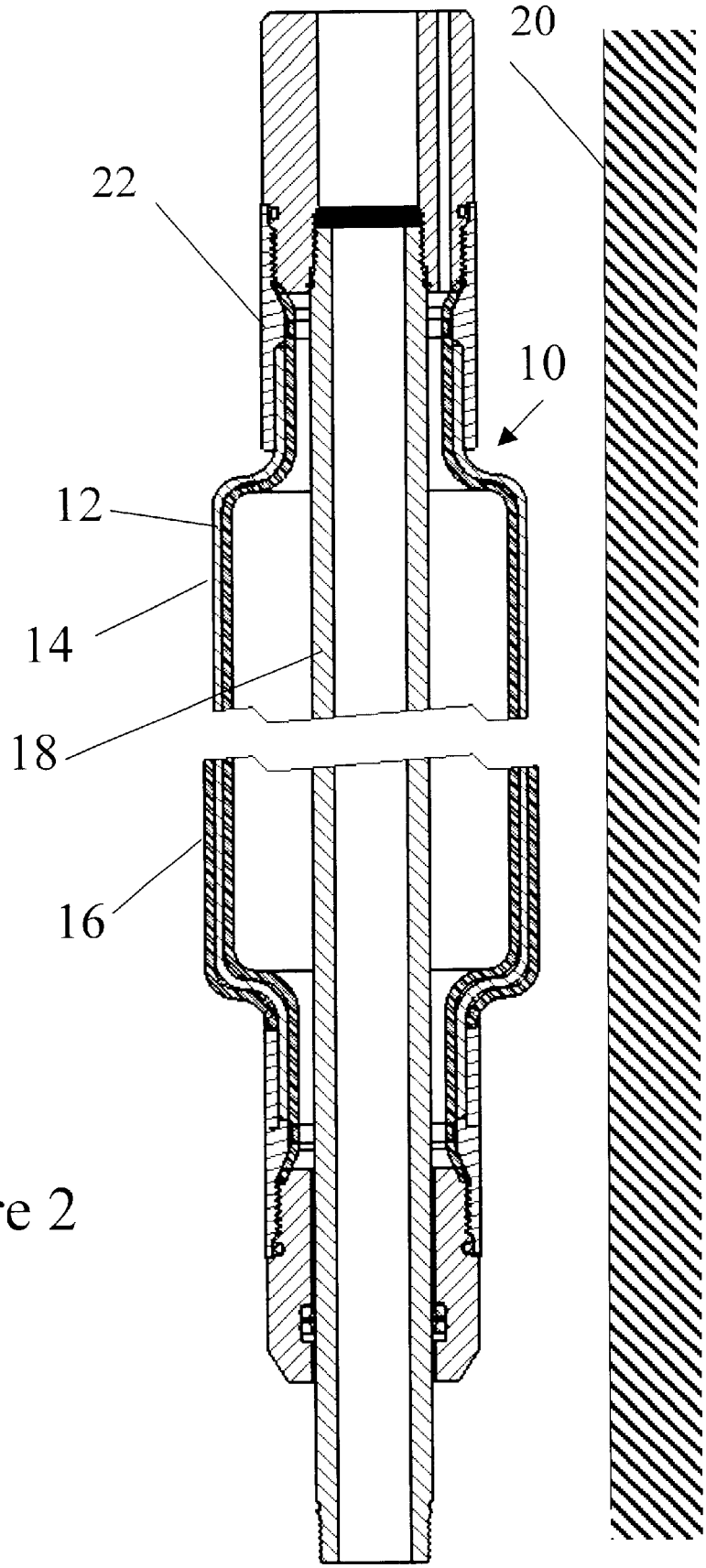
FIG. 2 depicts the initial stage of inflation where the packer is assumed to inflate uniformly across its length.

In one embodiment, each of the upper and lower packer subs may be fixed to the packer tube. In another embodiment, one of the packer subs may be fixed to the packer tube, and the other packer sub is movable or axially floating with respect to the packer tube, with the reinforcement layer providing a semi-rigid connector that keeps the desired pre-stretch in the bladder, as discussed below. FIG. 2 depicts the initial stage of inflation where the packer 10 appears to be expanding uniformly along its length. However, due to variations in the cross-section of the borehole 20, irregularities in the construction of the bladder 12, the reinforcement layer 14 or the cover layer 16, and/or due to different expansion where the end of the cover exposes the reinforcement layer, the bladder 12 may expand non-uniformly.

Figure 3:
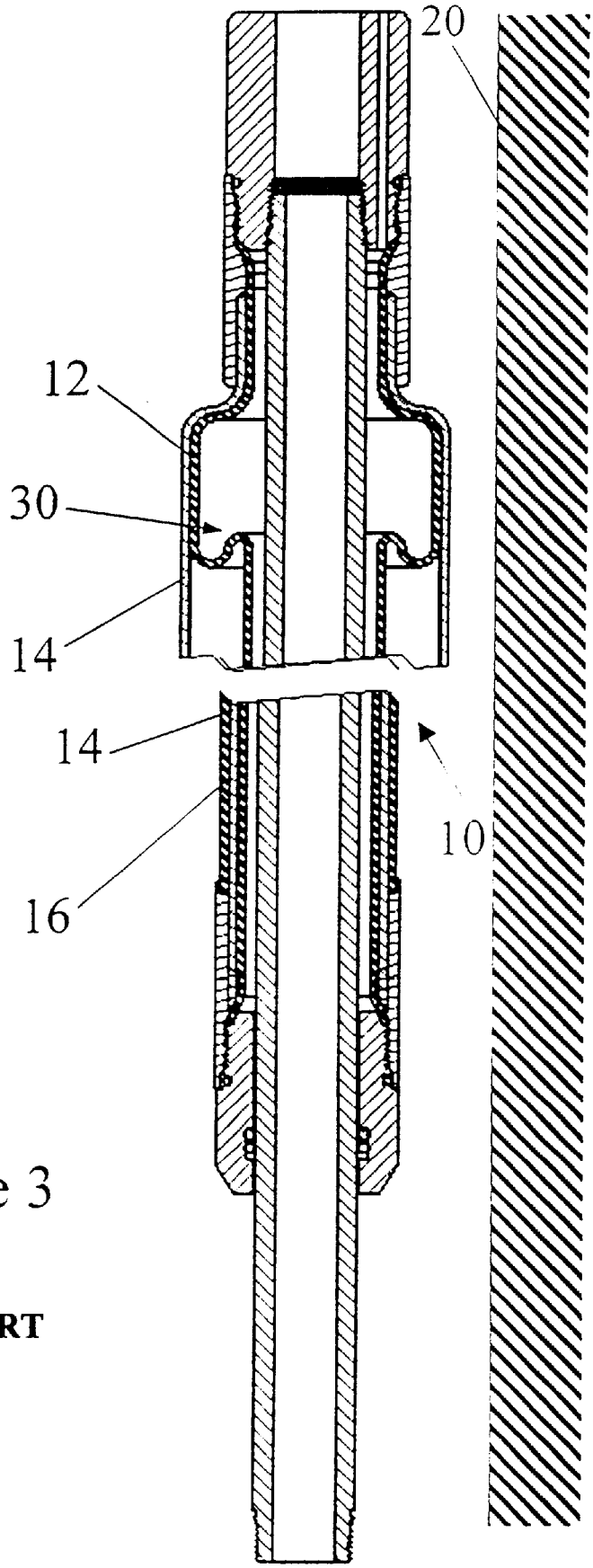
Figure 3 PRIOR ART
FIG. 3 shows the expansion of a conventional packer, without the benefit of a pre-stretched bladder. The covered portion of the reinforcement resists expansion, allowing the exposed portion to expand first. The bladder begins to fold over itself (Z-fold) at or near the interface of the lower end of the cover and the upper end of the exposed reinforcement.

FIG. 3 depicts the early stages of non-uniform expansion when a conventional packer starts to Z-fold. The cover 16 only covers a portion of the reinforcement 14, and the covered portion resists expansion more than the exposed portion. Consequently, the exposed portion of the packer 10 may but need not begin to expand first. The non-uniform expansion may increase the overall length of the bladder 12, and that excess length may accumulate in a Z-fold 30. Some areas within and adjacent to the Z-fold 30 may be highly stretched due to expansion, while other areas adjacent to the Z-fold 30 may be compressed due to the accumulation of excess length.

Figure 4:
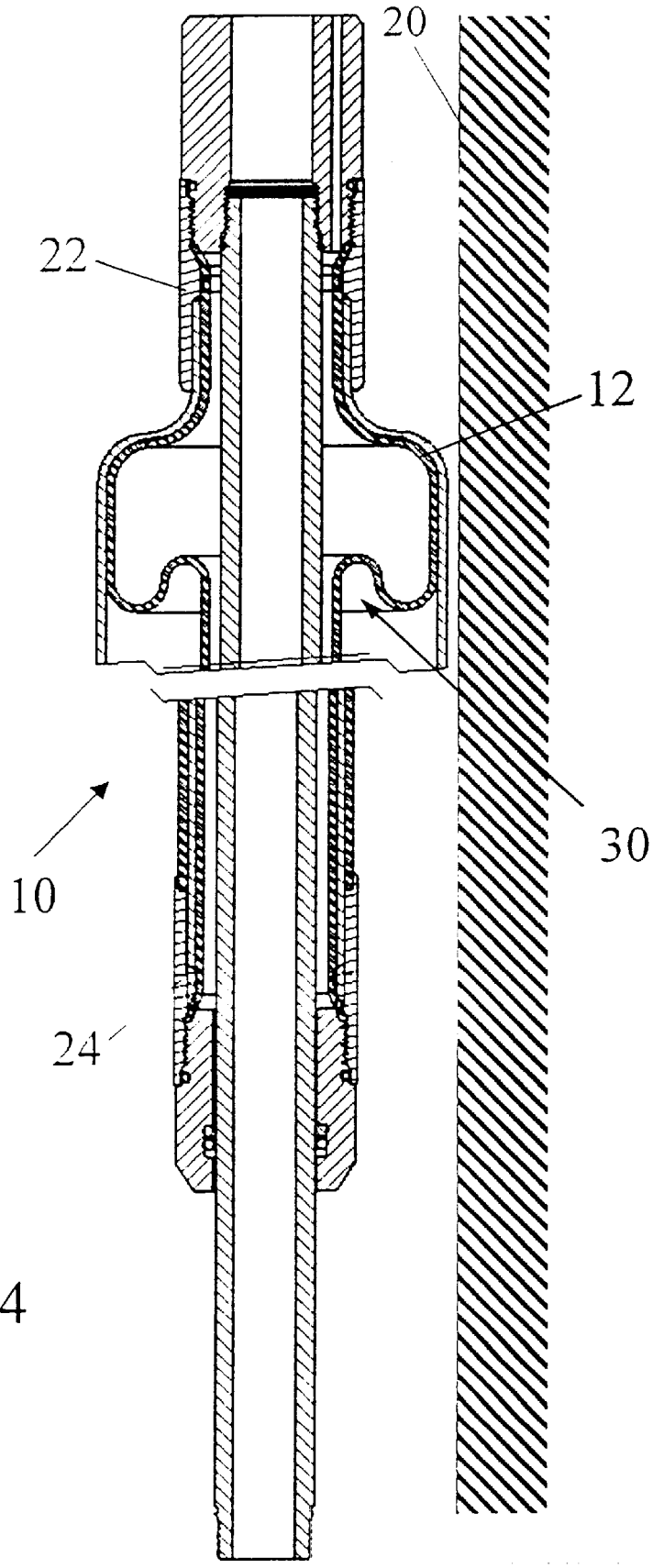
Figure 4 PRIOR ART
FIG. 4 shows a worsening of the Z-fold as expansion ratios become greater.

The Z-fold 30 may worsen with increased pressure and expansion, as shown in FIG. 4. If the resulting stresses exceed the elastic limit of the elastomer used in the bladder 12, the packer 10 will fail. Manufacturers have attempted various techniques to prevent Z-folding or to withstand the stresses of Z-folding. Nevertheless, packers fail often, and replacement is time consuming and costly. It is understood that one possible reason for a Z-fold has been discussed above, but that one or more Z-folds may occur at various points along the length of the packer. Imperfections of the bladder and/or irregularities in the reinforcing members may initiate a Z-fold in an area axially spaced from the cover.

Also, Z-folding of a bladder may occur in a packer which does not use a cover, and/or does not use a reinforcing layer.

Figure 5:
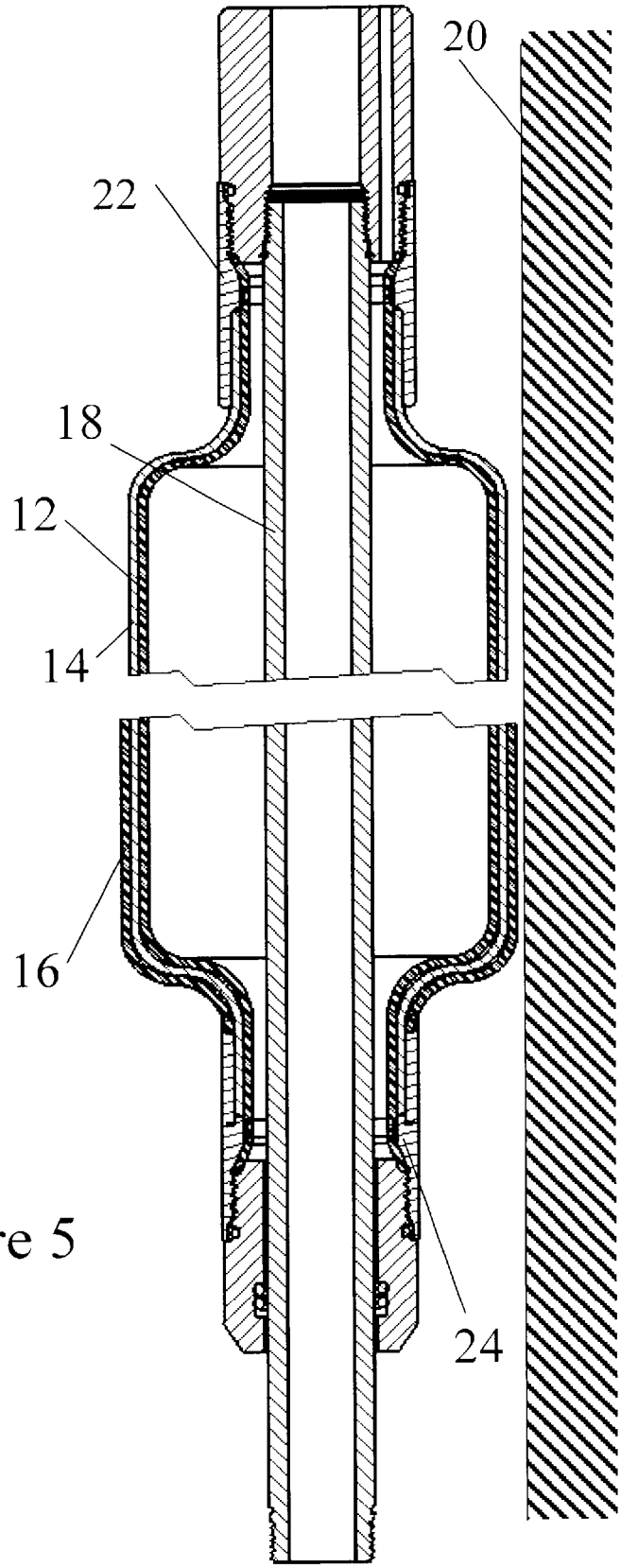
FIG. 5 shows an expansion similar to FIG. 3, but using a pre-stressed bladder. As the section of the packer element including the cover expands and the sliding end moves inward, the pre-stressed bladder maintains a positive tension and thus can fully expand without folding.

To minimize the risk of Z-folding, the bladder 12 is stretched between the upper and lower packer subs 22, 24 (shown as a combinations of 22 and 22*a*, 24 and 24*a*). In a pre-stretched configuration, i.e., stretched before inflations as shown in FIG. 5. The proper amount of pre-stretching effectively removes the excess length that would otherwise accumulate in a Z-fold. To illustrate: if an ordinary bladder were inflated to form a Z-fold, the excess length of material in the fold could theoretically be cut off and removed, and the severed ends of the bladder could be rejoined. Before the ends could be rejoined, however, the bladder would have to be stretched so the ends would meet. This is the minimum amount of pre-stretch that should be used to prevent Z-folds.

Figure 16:
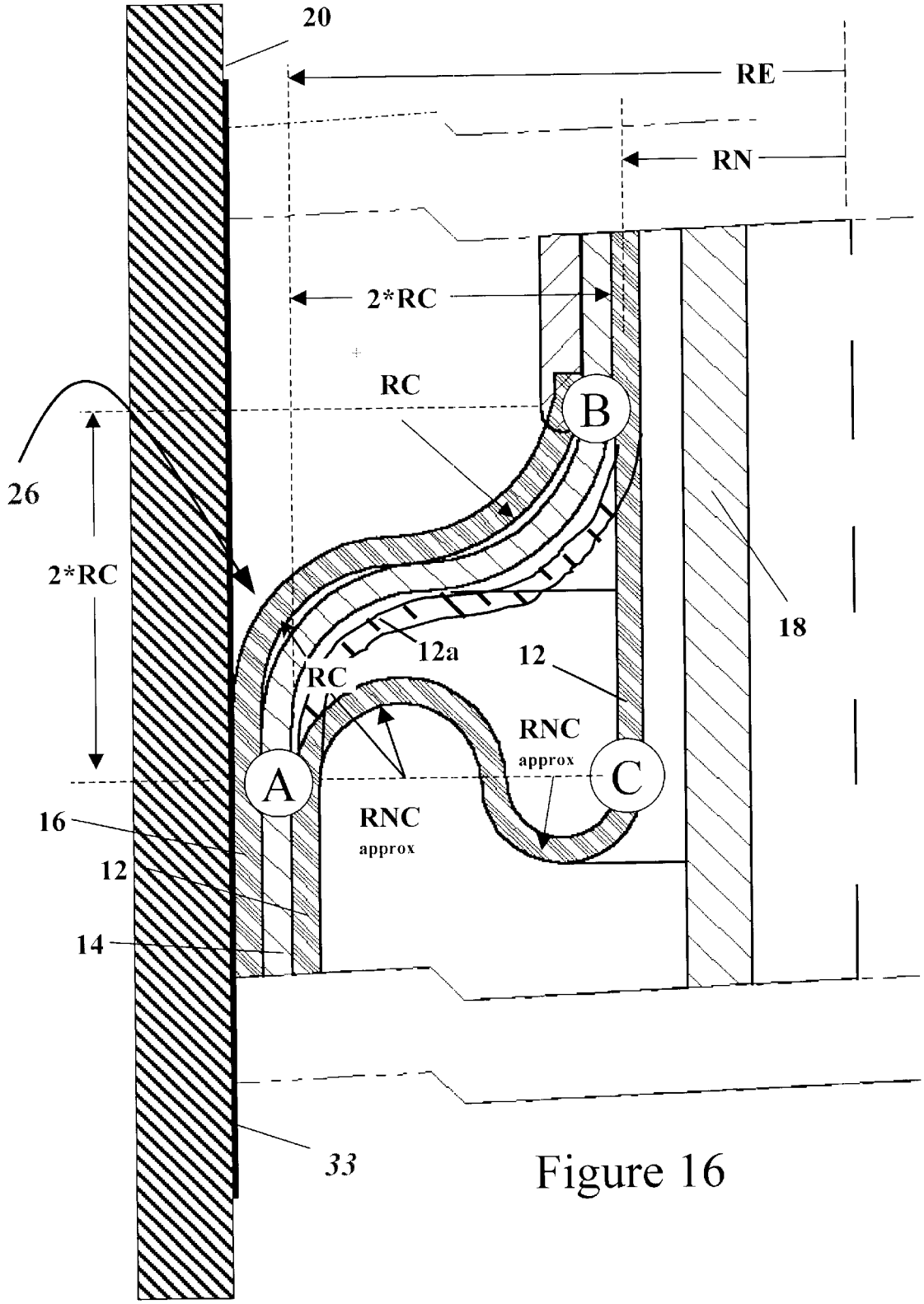
FIG. 16 compares the logical profile of a properly conforming pre-stretched bladder with the profile of a non-conforming, unstretched bladder, thereby supporting a mathematical formula to calculate the amount of pre-stretch required to eliminate Z-folds.

To estimate the accumulation of the length in a Z-fold, FIG. 16 aligns the profile of a properly conforming pre-stretched bladder, 12*a*, with the profile of a non-conforming unstretched bladder 12. A pre-stretched bladder 12*a* will make two 90 degree bends between points A and B, each with radius of conformity RC, which represents the bladder's inflated profile between one of the packer subs 22, 24 and a point of contact 26 with the borehole 20 corrected for the reinforcement layer 14 and cover 16, if provided (see FIG. 16). A Z-folded bladder, 12, will logically make two 180 degree bends between points A and C, each with radius of conformity RNC, along the Z-fold 30. Because a Z-fold is an accumulation of excess length, the distance along the non-conforming path A-C-B is greater than the distance along the conforming path A-B. Based on the geometry of FIG. 16, RC=2*RNC. The distance along the two 90 degree bends having radii RC is therefore equal to the distance along two 180 degree bends having radii RNC, which means the distance along path A-B equals the distance along path A-C. Thus, excess length in the Z-fold is equal to the remaining segment B-C. The length of segment B-C equals 2*RC, which is equal to the distance between the nominal radius of the bladder (RN) and a radius of engagement (RE) of the bladder when the packer is in engagement with the inner wall of the borehole 20. RE is thus reduced by the thickness of a residue layer 33 accumulated on the inner wall 20, and the thickness of the reinforcement layer and/or the cover layer. Thus, the minimum amount of pre-stretching to minimize Z-folding can be expressed in terms of RE and RN by the relation:

$$S \geqq n*(RE-RN)/L*100\%,$$

where

S=% stretch of the bladder;

n=maximum number of folds possible along the length of the bladder;

RE=radius of engagement of the tubular bladder anchoring locations to the centerline of the bladder thickness, which is half the nominal ID of the bladder or packer element, when the packer is in engagement with the wellbore;

RN=nominal radius of the tubular bladder, i.e., radius to the centerline of the bladder thickness before inflation; and L=axial length of the tubular bladder, i.e., the axial length between the bladder anchoring locations on the upper and lower packer subs.

For example, assume a 36" long bladder with an RN of 1.5" set in casing with a 9.5" nominal ID, reduced by an accumulation of residue plus the thickness of any reinforcement layer or cover layer, to 8.25". The radius of engagement RE is then ½*8.25"=4.12". The minimum stretch to fully compensate for one Z-fold is therefore 1*(4.12"−1.5")/36"*100%=7%.

Multiple Z-folds at various points along the length of a packer known to occur during inflation of the packer when using a conventional non-stretched bladder. The above formula takes into consideration the maximum number of Z-folds that may occur along the length of the packer. The worse case would be that Z-folds occurred "back-to-back", forming stacked Z-fold layers along the length of the packer. A packer, as discussed above may thus need a stretch of 7% to fully compensate for one Z-fold, and may need a stretch of 12×7% or about 84% to compensate for the maximum number of Z-folds possible along the length of the packer.

As a safety precaution, a manufacturer may choose to increase the amount of stretch in its packers well above the minimum as calculated above. For example, if a packer manufacturer predicts that a worst-case scenario requires a minimum stretch of 12% to eliminate Z-folding, the manufacturer may choose to increase this amount by a safety factor of 2, resulting in a stretch of 24%. Likewise, a manufacturer may choose to incorporate 50% stretch into all of its packers. An advantage of this "one size fits all" approach is to simplify the manufacturing process and reduce the cost of production and inventory. It may be impractical to customize every packer to every application.

Figure 6:
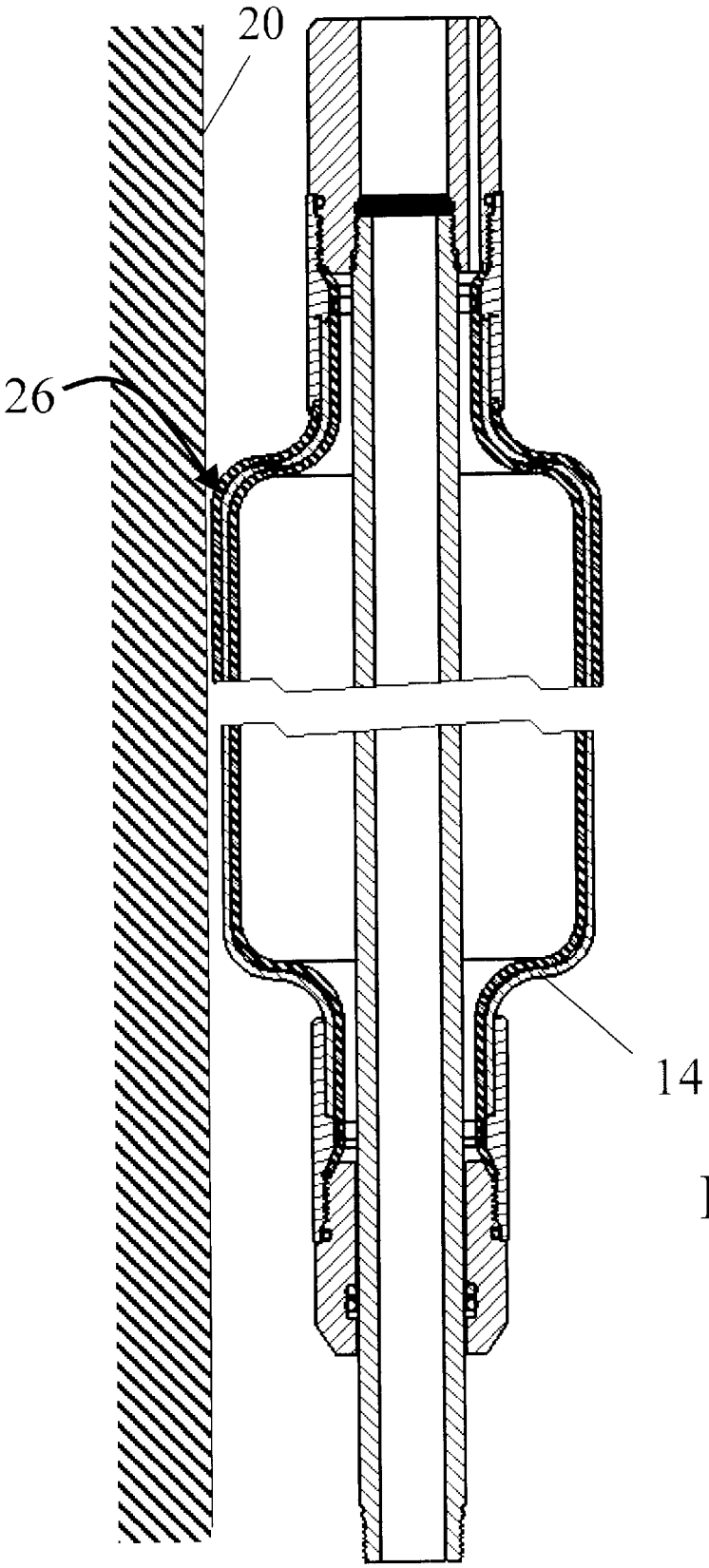
FIG. 6 shows an expansion similar to that of FIG. 5 using a pre-stressed bladder, wherein the exposed reinforcement will be on the lower end of the packer.
Figure 7:
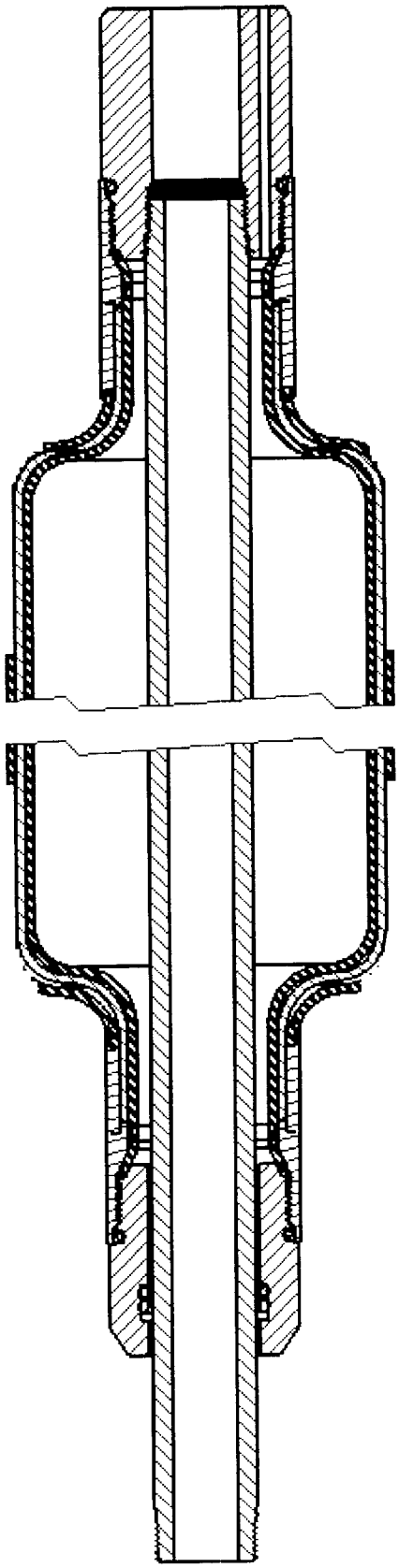
FIG. 7 shows an expansion of a pre-stressed bladder with exposed reinforcement on both ends.

Referring again to FIG. 1, the inflatable packer conventionally includes an inflate port 32 in the top sub or control sub, shown as a combination of 22 and 22*a*, to control the input of pressurized fluid between the mandrel 18 and the bladder 12. In FIGS. 1–5, the outer cover 16 was provided at the lower end of the packer, exposing the lower slats 14 to the wellbore wall when the packer is inflated. FIG. 6 shows a cover on an inflatable packer for exposing the reinforcement layer 14 on the lower portion of the packer, and FIG. 7 shows a cover in the middle of the packer, exposing the reinforcement layer 14 at the lower end and at the upper end of the packer. In other embodiments, the cover may be omitted so that all of the reinforcement layer is exposed, and yet in other embodiments no reinforcement layer or cover need be provided.

Many elastomers have properties that are desirable for use in downhole packers, such as high elongation, high strength and tear resistance. These properties could be hampered or accelerated in deterioration if a bladder is pre-stretched prior to setting. Creep of the pre-stretched bladder material may occur overtime, and deterioration may increase as the pre-stretched bladder is heated as the packer enters the well bore. Some elastomers which are well-suited for non-retrievable or permanent applications may not possess the memory required to pull out the Z-folds if the bladder is pre-stressed before going into the hole.

Figure 8:
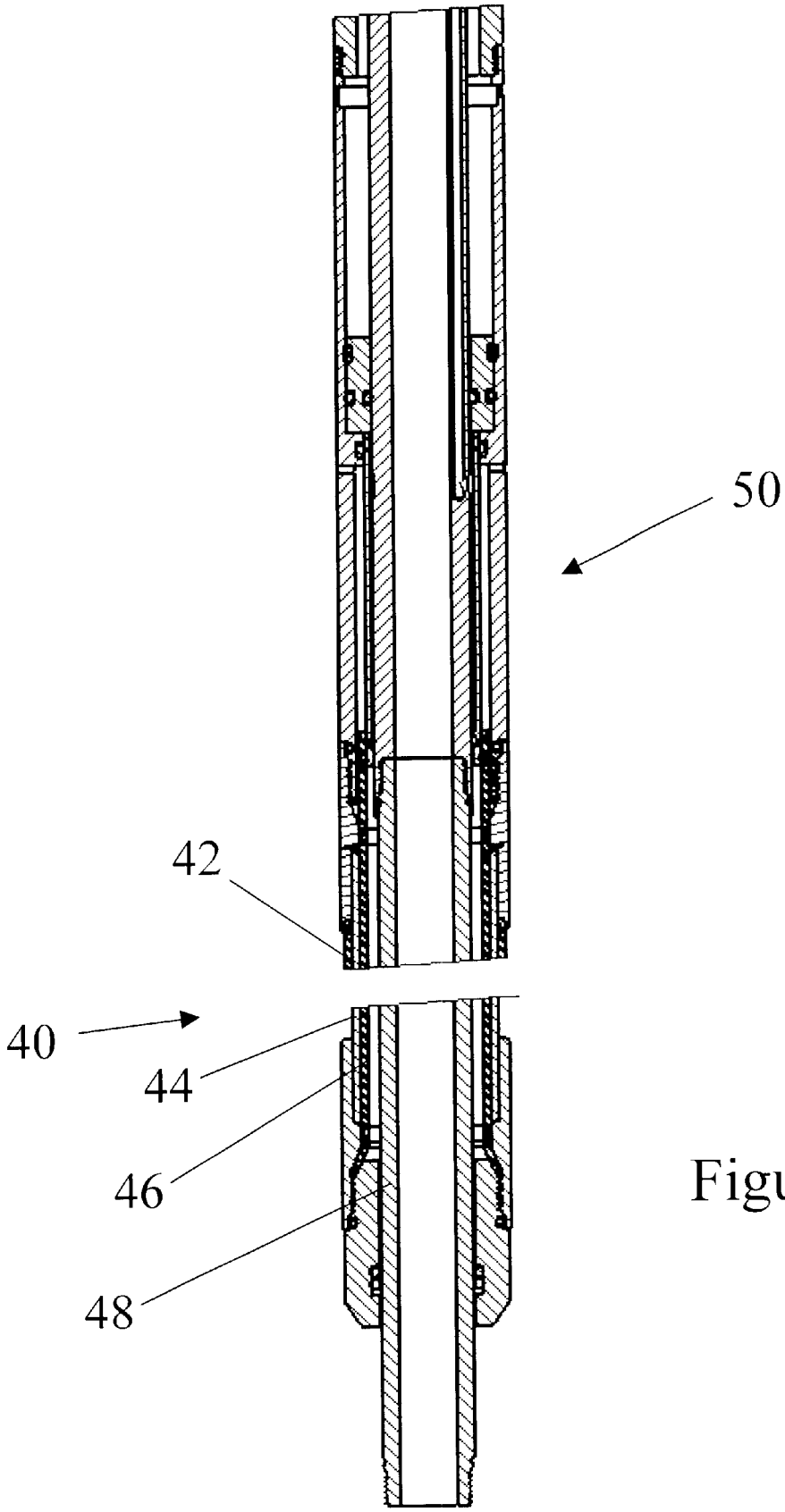
FIGS. 8–13 show a hydraulic method of stretching the bladder downhole, immediately prior to expansion.
Figure 9:
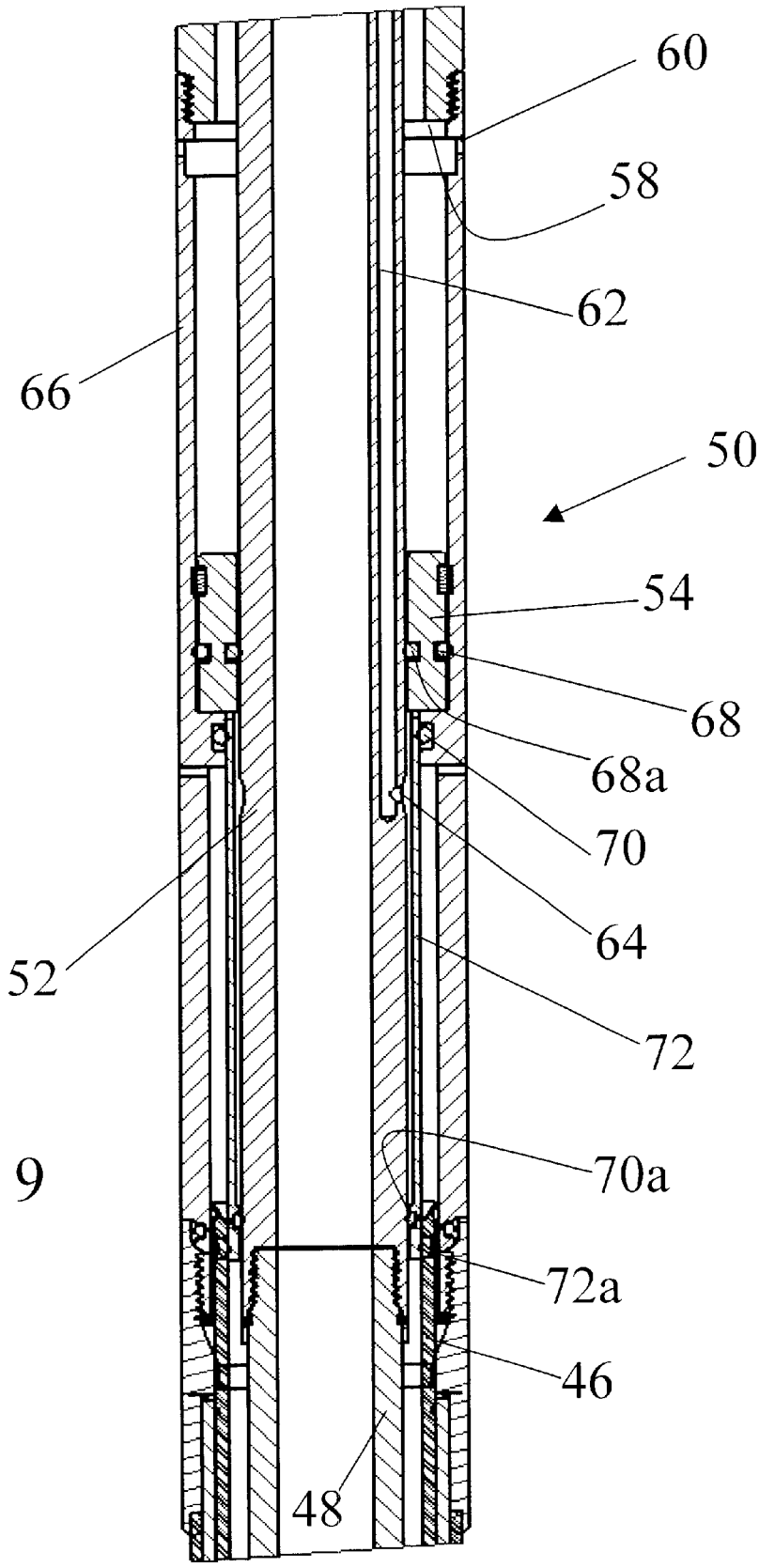

Although a bladder may be pre-stretched during manufacturing, a packer may alternatively be constructed to allow the user to pre-stretch the bladder after the packer is placed downhole, prior to inflation. FIGS. 8–13 illustrate a hydraulic method for stretching the bladder. In FIG. 8, the inflatable portion of the packer 40 is similar to the packer previously described, with a cover 42 exposing reinforcement layer 44, and the bladder 46 positioned about the mandrel 48. In FIG. 8, a bladder stretching mechanism 50 is provided for pre-stretching the bladder 46 before inflation while the packer is downhole. FIG. 9 depicts more clearly the stretching mechanism 50, with extension sub 52 threadably connected to the packer tube 48. If desired, the piston 54 may be axially connected to the extension sub 52 by a shear pin (not shown). Fluid pressure, when applied, moves the piston 54 upward toward the stop 58. A vent 60 is provided to vent to the wellbore. Inflatable passageway 62 in the extension sub 52 allows pressurized fluid to pass through inflation port 64 and act on the piston 54, which is sealed between the extension sub 52 and in the outer housing 66 by traveling seals 68 and 68*a*, with the latter seal being the inner seal of the piston 54 sealing with the extension sub 52. Seal 70 is in sealing engagement with piston extension sleeve 72, with the upper end of the bladder 46 being connected to the extension sleeve 72, which as depicted may include a dual purpose compressed clamp and a seal ring 72*a*. Seal 70*a* slidably seals extension sleeve 72 to extension sub 52, isolating the initial pressure fluid from passage 62 and the annular fluid between bladder 46 and packer tube 48, thus directing initial pressure fluid to the piston 54 for pre-stretch of the bladder. A desired amount of stretch can be controlled by the operator, both by controlling the fluid pressure to the piston 54 and by controlling the axial length of the components and the position of the stop 58. The bladder may thus be pre-stretched for inflation while the tool is downhole, prior to inflation.

Figure 10:
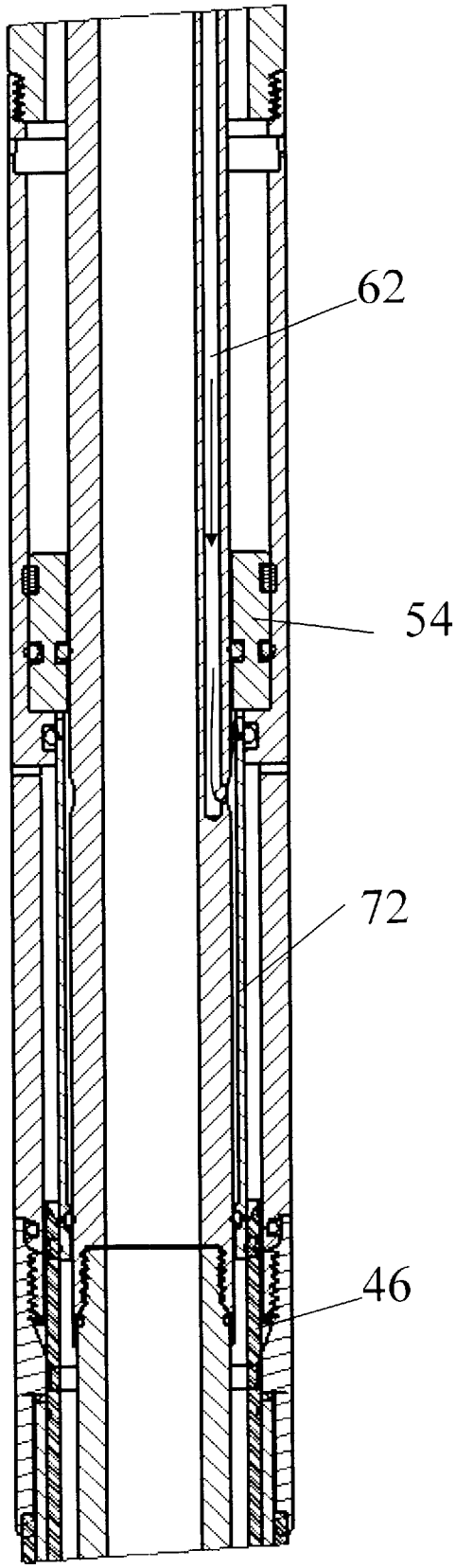
Figure 11:
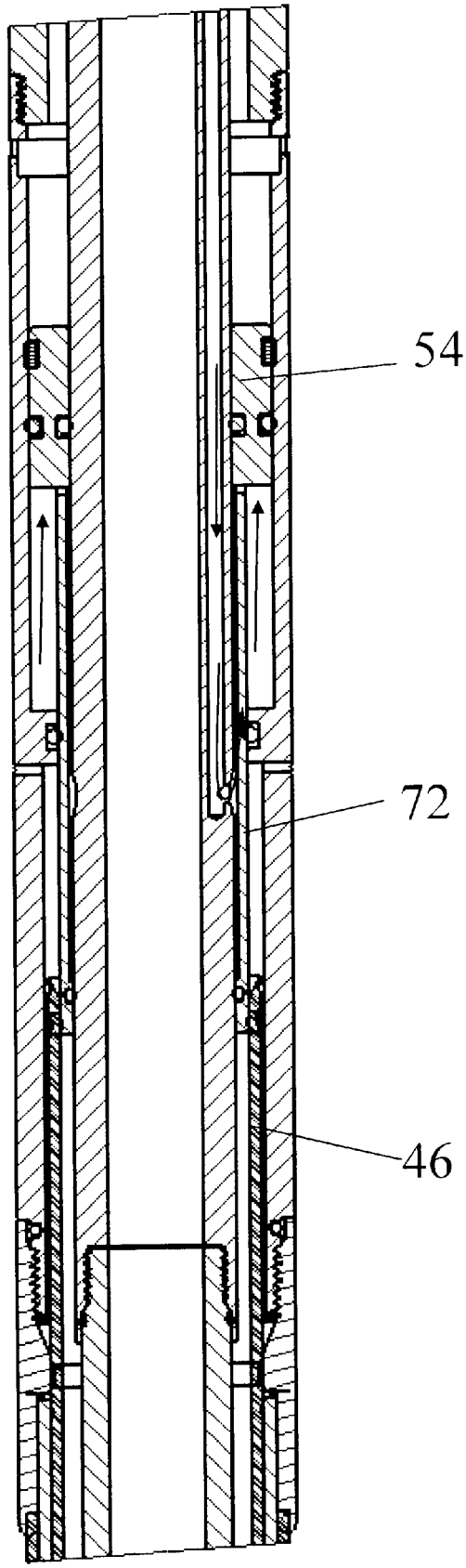
Figure 12:
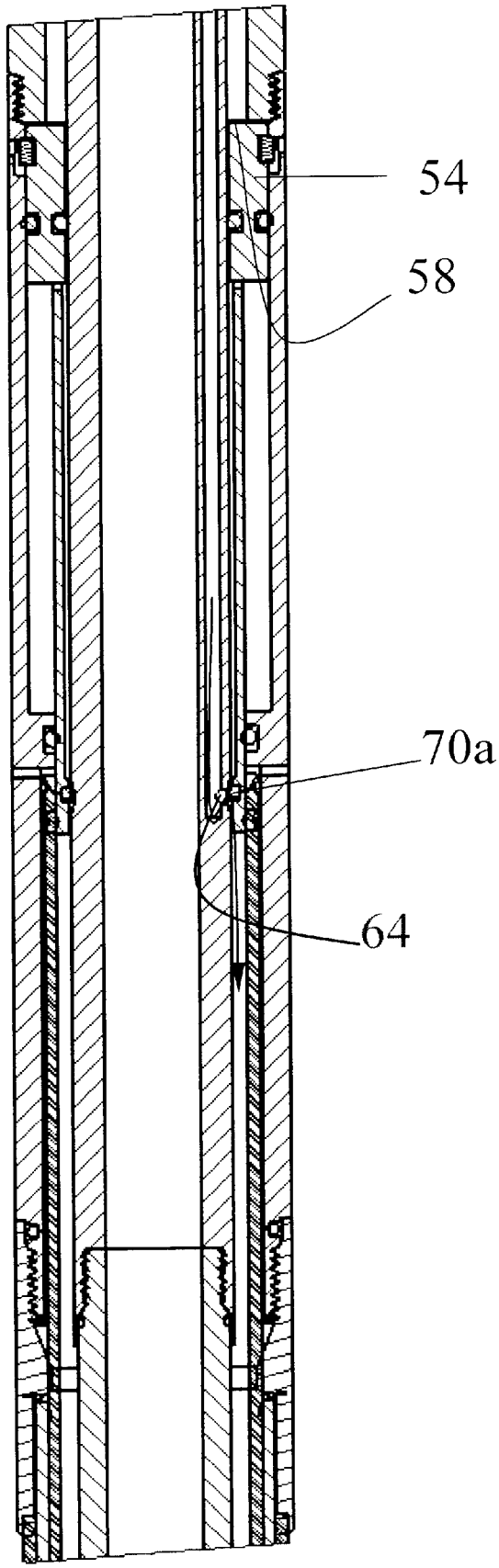
Figure 13:
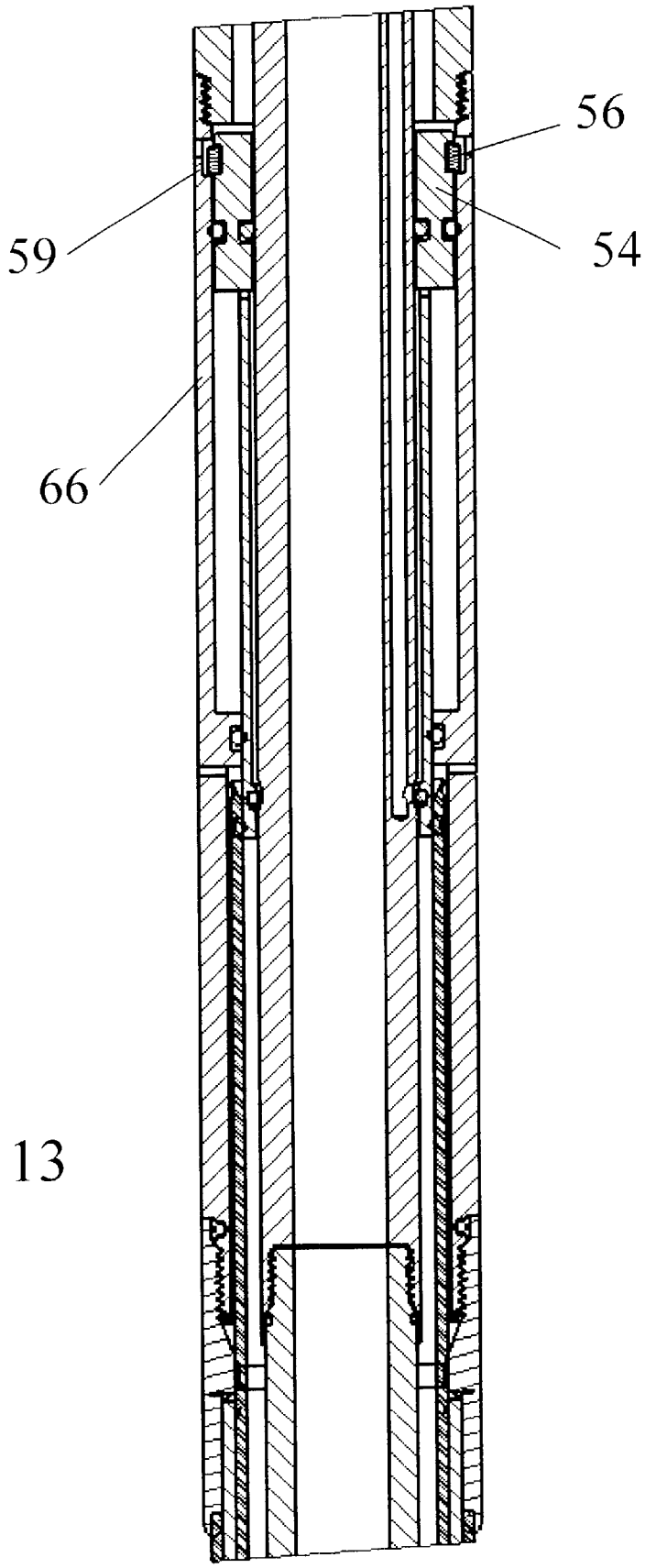

FIG. 10 illustrates with arrows fluid passing through the inflation passageway 62 to act on the piston 54 which moves upward as shown in FIG. 11, thereby pulling upward the extension sleeve 72 and stretching the bladder 46. In FIG. 12, the piston 54 has stopped when contacting stop 58, thus the bladder is fully stretched. Seal 70*a* now passes over the inflation port 64 and allows inflation of the bladder to begin. FIG. 13 illustrates the snap ring 56 carried by the piston 54 engaging the groove 59 in the outer body 66, thereby securing the piston to the outer housing 66 and keeping the bladder stretched, no longer requiring fluid pressure from the inflation port. The packer is then ready to be inflated in a conventional manner. Stretching the bladder immediately prior to inflation may increase the life of the packer and minimize wear and tear to its components prior to use. This option may also allow the user to customize the amount of pre-stretch to a variety of applications.

It should be understood that the packer as discussed above is constructed so that the bladder is axially stretched substantially before the packer is inflated. In other embodiments, fluid pressure force applied to the packer may cause the packer to inflate while the bladder is stretched, or stretching of the bladder and inflation of the packer may occur in stages, e.g., 10% bladder stretch prior to or in conjunction with an initial inflate, followed by 25% bladder stretch prior to or in conjunction with intermediate inflation, followed by a 50% bladder stretch and full inflation. In each case, the piston 54 as discussed above "pulls out" the Z-folds in the bladder as they occur or prevents the Z-folds from occurring. In clarification of this alternate method, one can refer to the method shown in FIGS. 8–13 and simply have seal 70*a* removed. This would allow pressure fluid to act on piston 54 while simultaneously pressuring the bladder. Thus, as Z-folds form, motion of the piston would pull them out.

Figure 14:
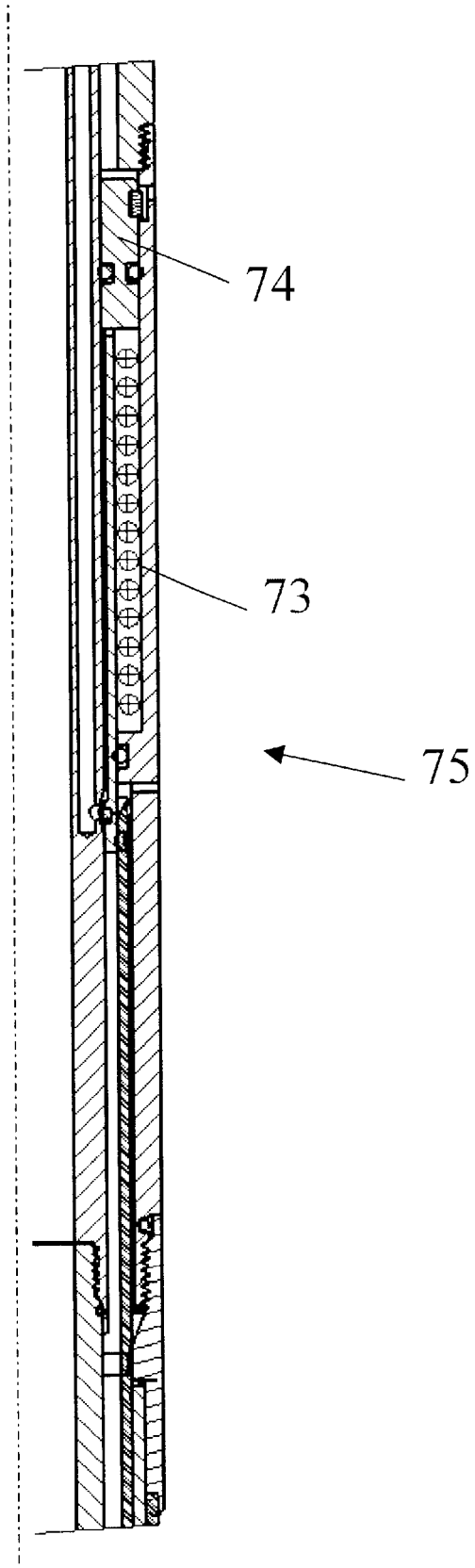
FIG. 14 shows a method of stretching a bladder using a releasable device containing mechanically stored energy (a spring).
Figure 15:
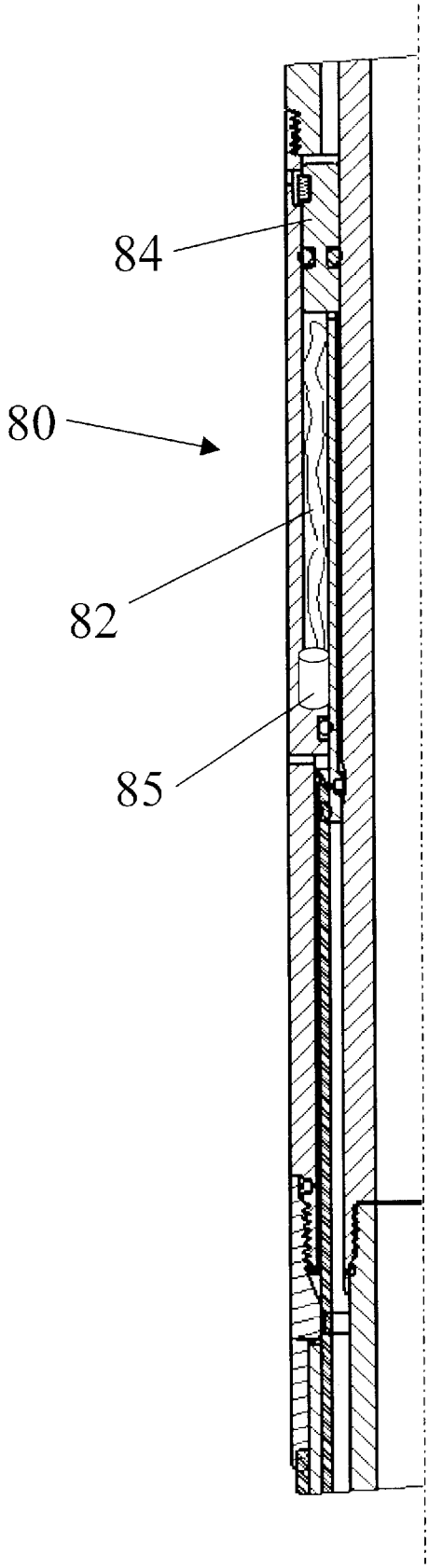
FIG. 15 shows a method of stretching the bladder using a releasable device containing pneumatic stored energy (compressed gas).

FIG. 14 illustrates a pre-stretching mechanism 75 for stretching the bladder with mechanically stored energy, such as spring 73. Spring 73 thus moves the head member 74 upward when the spring is released, thus pulling the bladder upward and stretching the bladder as previously described. FIG. 15 illustrates a pre-stretching mechanism 80 which uses pneumatic-stored energy, such as compressed air or nitrogen gas. Once the canister 85 is punctured, the compressed air is released, thus driving the piston 84 upward.

Figure 17:
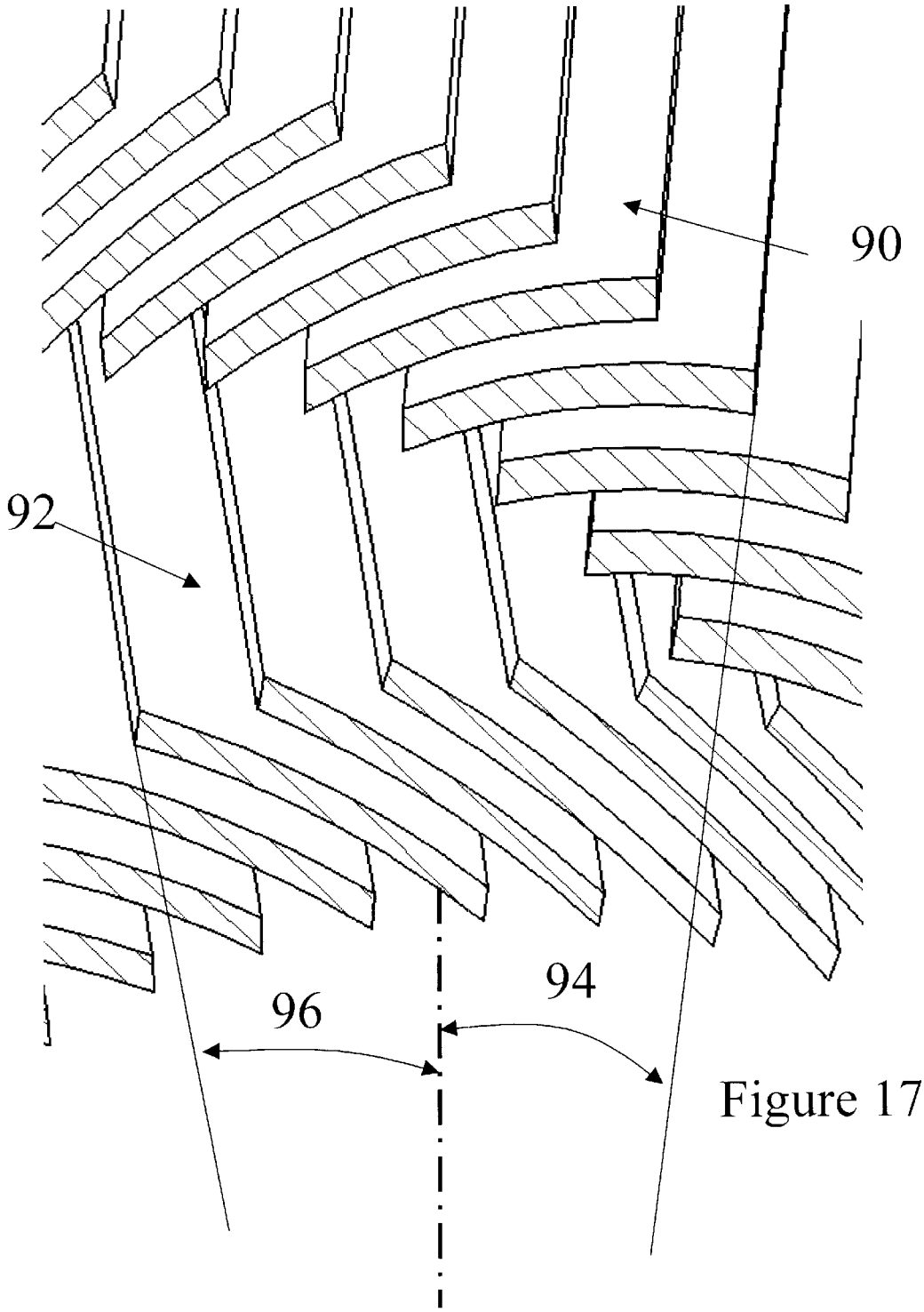
FIG. 17 is a pictorial view of a preferred reinforcement layer, with oppositely directed angled slats attached at the ends to the packer subs.

The reinforcement layer may comprise a plurality of circumferentially arranged slats, cables, or other reinforcing structure. In some applications, a reinforcing layer comprising a plurality of overlapping cables or a composite material reinforcing layer may be preferred. In a preferred embodiment, the reinforcement layer comprises a plurality of circumferentially arranged right-hand slats 90 as shown in FIG. 17 and a similar plurality of left-hand slats 92. Either the left-hand slats or the right-hand slats may be the radially inner slats. By angling the slats in both the inner and outer layers in reverse directions, a highly reliable and uniform enforcement layer is obtained which, in conjunction with the stretched bladder as discussed above, achieves an improved downhole packer. The separation between the slats in the inner layer will not result in a gap but instead will be covered over by a slat in the outer layer. In another embodiment, both slats are arranged in the same slant or direction, but preferably at different inclinations. By providing one layer of slats with a clockwise or right-hand slant and another layer of slats with a counterclockwise or left-hand slant, expansion of both layers cancels out twisting forces. The angle of the outer layer of slats may also allow substantially higher torque to be imparted to the inflatable packer before the packer would break loose from gripping engagement with the casing or open hole compared to a packer according to the prior art. Also, each slat in one layer may be parallel to the central axis of the packer, and the other layer angled. The angled slat layers could also be in the same direction, but at a different inclination.

Referring again to FIG. 1, the annular space between the reinforcement layer 14 and the packer tube 18 may be limited. In one embodiment, the bladder 12 is stretched during manufacture and before placing the tool downhole, and the bladder 12 before stretching is thicker than the annular space between the reinforcing layer 14 and the packer tube 18. This procedure allows a thicker bladder 12 to be used, since the bladder 12 before stretching may have a thickness greater than the radial spacing between the OD of the packer tube 18 and the ID of the reinforcement layer 14.

To manufacture a packer with a pre-stretched bladder 12 with the bladder before stretching having a thickness greater than the radial spacing in between the packer tube and the reinforcement layer, the following procedure may be used. Assuming that the packer includes reinforcement layer, the bladder may be inserted within the reinforcement layer and one end of the bladder fixed to a packer head, which in turn is axially secured to one end of the reinforcement layer. The bladder may then be stretched from the other end of the packer to the extent desired, then the stretched bladder fixed to the opposing packer head, which is effectively secured to the opposing end of the reinforcement layer. The stretched bladder now has an ID sufficient to receive the packer tube or mandrel which passes through the stretched bladder. With the mandrel in place, the bladder stretching unit may release its force, so that the stretched bladder is between the reinforcement layer and the packer tube, and the bladder is thereafter held in tension by the reinforcing layer, which limits movement of the packer subs axially toward each other.

In order to prestretch the bladder to remove the likelihood of Z-fold, the bladder need not always be stretched to the extent required according to the previously discussed formula. If prestretching the bladder takes out some but not all of the increased length of a bladder due to non-uniform expansion, the stretching will still have a benefit of reducing the likelihood of Z-folds. For most applications, the manufacturer of a packer with a prestretched bladder does not want to customize the stretch of a bladder for a particular application, and instead will prestretch bladders for a certain size packer so that Z-folding will be reduced for numerous applications in which a customer may use the packer. According to the present invention, prestretching of a bladder at least 10% is practically necessary to obtain the significant benefits of the invention. In many applications, the manufacturer may want to prestretch the bladders to 25% or more, and in other applications the bladder may be stretched at least 40% above its prestretched length.

The packer as discussed above includes a packer tube having an internal throughbore for fluid flow. The term "packer tube" as used herein is broadly intended to mean any elongate member for interconnection with the tubular string for positioning in a wellbore to support the bladder outside the tube. The packer tube may have no throughbore, in which case the packer effectively becomes an inflatable plug.

The packer discussed above, includes inflation ports which have been shown as internal geometries in the upper packer sub. These ports alternatively may be in any form which conveys fluid (fluid/slurry/gas) for placing inflate media between the packer tube and bladder. The inflate port may thus be an internal hole in the packer tube that is straddled by a packer inflation tool which may move independent of the packer tube, the same internal hole passing through a logic valve that may trap internal pressure and then not be affected by additional pressuring of the running string, or an external inflate line that may be independent of the tubular or wireline attached to the packer tube. The external inflate line may enter the packer in close proximity to the bladder attachment to the packer sub and thus not interfere with any of the inner workings of the packer.

It may be appreciated that changes to the details of the illustrated embodiments and systems disclosed are possible without departing from the spirit of the invention. While preferred and alternative embodiments of the present invention have been described and illustrated in detail, it is apparent further modifications and adaptations of the preferred and alternative embodiments may occur to those skilled in the art. However, it is to be expressly understood that such modifications and adaptations are within the spirit and scope of the present invention, set forth in the following claims.

What is claimed is:

1. An inflatable packer for positioning downhole from a tubular string and for sealing downhole in a wellbore, the packer comprising:

a packer tube for supporting at the tubular string in the wellbore;

an upper packer sub and a lower packer sub each supported on the packer tube; and an elastomeric bladder extending between the upper packer sub and the lower packer sub, the bladder being axially stretched prior to inflation between the upper and lower packer subs to satisfy the relationship:

$$S \geqq n*(RE-RN)/L*100\%,$$

where

S=stretch of the bladder (%);

n=maximum number of folds along the length of the bladder;

RE=radius of engagement of the bladder when packer is inflated in the borehole;

RN=nominal radius of the tubular bladder; and

L=length of the bladder.

2. An inflatable packer as defined in claim 1, wherein, the packer tube includes an internal bore for fluid flow.

3. An inflatable packer as defined in claim 1, wherein the bladder is axially pre-stretched an amount in excess of 25% beyond its unstretched length.

4. An inflatable packer as defined in claim 1, wherein the bladder axially pre-stretched an amount of at least 40% beyond its unstretched length.

5. An inflatable packer as defined in claim 1, further comprising:

a reinforcement layer surrounding at least a portion of the bladder for engaging an inner wall of the wellbore.

6. An inflatable packer as defined in claim 5, wherein a radial thickness of the bladder prior to being axially stretched is greater than a radial spacing between an OD of the packer tube and an ID of the reinforcement layer, such that the bladder is axially stretched to reduce its radial thickness to fit within the radial spacing.

7. An inflatable packer as defined in claim 5, comprising:

a sleeve-shaped cover surrounding at least a portion of the reinforcement layer and having an end spaced axially from both the upper sub and the lower sub to expose a portion of the reinforcement layer.

8. An inflatable packer as defined in claim 5, the reinforcement layer comprising a plurality of circumferentially arranged slats.

9. An inflatable packer as defined in claim 8, wherein the circumferentially arranged slats are arranged in an inner layer and an outer layer, and the slats in the outer layer are angled with respect to the slats in the inner layer.

10. An inflatable packer as defined in claim 5, the reinforcement layer comprising a plurality of overlapping cables.

11. An inflatable packer as defined in claim 1, wherein at least one of the upper packer sub and the lower packer sub is axially movable relative to the packer tube while the packer is downhole to axially stretched the bladder between the upper packer sub and the lower packer sub prior to inflation.

12. An inflatable packer as defined in claim 11, wherein one of hydraulic and pneumatic pressure moves at least one of the upper packer sub and the lower packer sub relative to the packer tube to pre-stretch the bladder.

13. An inflatable packer as defined in claim 11, further comprising:

a mechanical biasing member to move the at least one of the upper packer sub and the lower packer sub relative to the packer tube to pre-stretch the bladder.

14. An inflatable packer for positioning downhole from a tubular string and for sealing down hole in a wellbore, the packer comprising:

a packer tube for supporting at the tubular string in the wellbore;

an upper packer sub and a lower packer sub each supported on the packer tube; and an elastomeric bladder axially stretched prior to inflation between the upper packer sub and the lower packer sub at least 10% beyond its unstretched length;

a reinforcement layer surrounding at least a portion of the bladder for engaging an inner wall of the wellbore; and a sleeve-shaped cover surrounding at least a portion of the reinforcement layer and having an end spaced axially from both the upper packer sub and the lower packer sub to expose a portion of the reinforcement layer; wherein a radial thickness of the bladder prior to being axially stretched is greater than a radial spacing between an OD of the packer tube and an ID of the reinforcement layer, such that the bladder is axially stretched to reduce its radial thickness to fit within the radial spacing.

15. An inflatable packer as defined in claim 14, wherein the elastomeric bladder is axially pre-stretched at least 40% beyond its unstretched length.

16. A method for inflating an inflatable packer positioned downhole from a tubular string and for sealing downhole in a wellbore, the packer comprising:

a packer tube for supporting at the tubular string in the wellbore;

supporting an upper packer sub and a lower packer sub on the packer tube;

axially stretching an elastomeric bladder between the upper packer sub and the lower packer sub prior to inflation to satisfy the relationship;

$$S \geqq n*(RE-RN)/L*100\%,$$

where

S=stretch of the bladder (%);

n=maximum number of folds along the length of the bladder;

RE=radius of engagement of the bladder when packer is inflated in the borehole;

RN=nominal radius of the tubular bladder; and

L=length of the bladder.

17. A method as defined in claim 16, further comprising:

providing a reinforcement layer surrounding at least a portion of the bladder for engaging a side wall of the wellbore.

18. A method as defined in claim 17, wherein a radial thickness of the bladder is greater than a radial spacing between an OD of the packer tube and an ID of the reinforcement layer, and the elastomeric bladder is axially stretched to reduce its radial thickness prior to fitting the bladder between the OD of the packer tube and the ID of the reinforcement layer.

19. A method as defined in claim 18, further comprising:

providing a sleeve-shaped cover surrounding at least a portion of the reinforcement layer and having an end spaced axially from both the upper packer sub and the lower packer sub to expose a portion of the reinforcement layer.

20. A method as defined in claim 16, wherein both the upper packer sub and the lower packer sub are fixed with respect to the packer tube, and the bladder is axially pre-stretched between the upper packer sub and the lower packer sub prior to positioning downhole.

21. A method as defined in claim 16, wherein at least one of the upper packer sub and the lower packer sub is axially moved relative to the packer tube while the packer is downhole to axially pre-stretch the bladder prior to or during inflation of the downhole packer.

22. An inflatable packer for positioning downhole from a tubular string and for sealing downhole in a wellbore, the packer comprising:

a packer tube for supporting at the tubular string in the wellbore;

an upper packer sub and a lower packer sub each supported on the packer tube; and an elastomeric bladder stretched prior to inflation between the upper packer sub and the lower packer sub at least 10% beyond its unstretched length;

both the upper packer sub and the lower packer sub being fixed axially with respect to the packer tube;

a reinforcement layer surrounding at least a portion of the bladder for engaging an inner wall of the wellbore; and a radial thickness of the bladder prior to being axially stretched is greater than a radial spacing between an OD of the packer tube and an ID of the reinforcement layer, such that the bladder is axially stretched to reduce its radial thickness to fit within the radial spacing.

23. The inflatable packer as defined in claim 22, wherein the packer tube includes an internal bore for fluid flow.

* * * * *